US006187143B1

(12) United States Patent
Juppo et al.

(10) Patent No.: US 6,187,143 B1
(45) Date of Patent: Feb. 13, 2001

(54) PROCESS FOR THE MANUFACTURE OF HYDROPHOBIC PAPER OR HYDROPHOBIC BOARD, AND A SIZING COMPOSITION

(75) Inventors: Ari Juppo, Vantaa; Aarto Paren, Vaasa, both of (FI)

(73) Assignee: Kemira Chemicals OY, Helsinki (FI)

( * ) Notice: Under 35 U.S.C. 154(b), the term of this patent shall be extended for 0 days.

(21) Appl. No.: 09/384,751

(22) Filed: Aug. 27, 1999

(30) Foreign Application Priority Data

Sep. 4, 1998 (FI) ..... 981892

(51) Int. Cl.[7] ..... D21F 11/00

(52) U.S. Cl. ..... 162/158; 162/180; 162/181.1; 162/143; 162/183; 106/238

(58) Field of Search ..... 162/180, 181.1, 162/158, 143, 183; 106/238, 218

(56) References Cited

U.S. PATENT DOCUMENTS 4,699,663 * 10/1987 Feeney ..... 106/218
5,308,441 * 5/1994 Kern ..... 162/158

FOREIGN PATENT DOCUMENTS 0 054 075 6/1980 (EP) .
0 073 872 A1 3/1983 (EP) ..... D21C/9/00
0 537 359 A1 3/1992 (EP) .
77884 1/1989 (FI) .
6-219038 8/1994 (JP) ..... D21H/17/21

OTHER PUBLICATIONS

Jinfeng Zhuang and Christopher J. Biermann, Rosin soap sizing with ferric and ferrous ions as mordants; vol. 76, No. 12 Tappi Journal; Dec. 1993.
Esa Lipponen, Paperin liimaus.
Walter F. Reynolds, The Sizing of Paper Second Edition, 1989.

* cited by examiner

*Primary Examiner*—Stanley S. Silverman
*Assistant Examiner*—Mark Halpern
(74) *Attorney, Agent, or Firm*—Greenberg Traurig LLP; Joseph M. Manak

(57) ABSTRACT

The invention relates to a process for the manufacture of hydrophobic paper or board by using rosin sizing, an organic complexing agent being used together with the rosin size. The invention also relates to a sizing composition.

15 Claims, No Drawings

PROCESS FOR THE MANUFACTURE OF HYDROPHOBIC PAPER OR HYDROPHOBIC BOARD, AND A SIZING COMPOSITION

The present invention relates to a process for the manufacture of hydrophobic paper or hydrophobic board by using rosin sizing. The invention also relates to a sizing composition which contains rosin size.

Rosin and rosin-based sizes have long been used for the sizing of board and paper when the stock is acidic or almost neutral. Size is used by adding it to the fiber stock from which a web is later formed on the wire. The purpose of the use of size is to increase the hydrophobicity of the paper or board.

Rosin sizing is based on the forming of electrostatic bonds between the size and the cellulose or other fibers or solids in the stock or the paper web. With the present-day reaction products of anhydrides and rosinous substances a better sizing result is obtained than with products which contain only rosinous substances. Such reaction products are called reinforced rosin sizes. In general, an aqueous dispersion is formed of the sizes in order to facilitate dosing. Stable dispersions of rosin or rosin-based products are well known.

Rosin is a solid substance present in the pitch of pine trees, Its principal component is abietic acid, which can react with fumaric acid, maleic acid or its anhydride, whereby the active agent of reinforced sizes is formed. These reinforced sizes can be treated further with formaldehyde and alcohols.

The preparation of rosin sizes is generally known technology.

The preparation and formulation of a rosin size is described in, for example, patent FI-C-77884.

Rosin sizes are in general stabilized with substances which form a shielding colloid around the resin particles. Usually there is used for this purpose a modified starch or natural polymers or synthetic polymers, such as polyvinyl alcohols, polyvinyl pyrrolidone or cellulose derivatives, such as carboxymethyl cellulose. The use of rosin size stabilization agents is generally known technology.

Aluminum salts, which may be of any type which is commonly known to be usable for the sizing and hydrophobification of cellulose and other fibers, such as aluminum sulfate, aluminum chloride, polyaluminum chloride, polyaluminum sulfate, and mixtures thereof, are essential for the use and performance of a rosin size. It is generally known that the amount of alum required in rosin sizing is approx. 1.5 times that of the rosinous substance (W. F. Reynolds, The Sizing of Paper, second edition, 1989, pages 1–31), and the highest possible cationic charge is obtained when 1–1.5 equivalents of the $Al^{3+}$ ion are neutralized with the OH ion. In this case the pH is 4–5. It is known that $Ca^{2+}$ and $Mg^{2+}$ ions weaken the sizing effect by decreasing the negative charge of the rosin size and by forming disadvantageous precipitates. Problems appear in particular when the pulps are prepared in hard water or when calcium carbonate is used as a filler. Calcium carbonate buffers the pulp within a pH range of 7–8. Efforts have been made to improve the performance of rosin size in this environment by using dispersion sizes of very small particle size. By means thereof, rosin sizes can be caused to react with aluminum only in the drying section, where water no longer serves as the continuous phase and the size is no longer in contact with carbonate. On the other hand, efforts have been made to increase the interaction between aluminum and rosin size by dosing them at the same location into the short cycle of diluted pulp.

The quality properties of board for the packaging of liquids include not only hydrophobicity of the board, which is generally defined as Cobb numbers, but also resistance to the penetration of lactic acid from the edge of the board (lactic acid REP) and resistance to the penetration of hydrogen peroxide (peroxide REP). The numbers illustrate the penetration of the said solutions from the board edge towards its cross-sectional area.

Resistance to peroxide is necessary since the board is treated in a hot hydrogen peroxide bath before the manufacture of packaging. Resistance to lactic acid is necessary or the packaging being resistant to the milk and other liquid food products to be stored therein. In general, in order to achieve effective sizing, an AKD (alkyl ketene dimer) size is also used in the manufacture of liquid packaging board. An AKD size which can be used together with a rosin size is usually an aqueous dispersion.

The concentration of AKD in the products may be 0.5–30% by weight. In general there are used for the formulation of AKD various starches, which are generally cationated either with quaternary amines, in which case the starch retains its cationic charge even in alkaline conditions, or with primary, secondary or tertiary amines, the charge of which is dependent on the pH. The amount of starch may be 0.1–10 times the proportion of AKD. In general there are used for the dispersing of an AKD wax various anionic compounds, such as lignosulfates, aliphatic or aromatic sulfonates, nonionic surfactants such as fatty acid or fatty alcohol ethoxylates, or cationic surfactants such as fatty acid amines or imidazolines. It is also possible to use, for the stabilization of an AKD dispersion, polymers such as polyethylene irine, polyepiamine, polydimethyldiallyl or dicyandiamide compounds, polyacrylamide or polyacrylic acid and its salts. It is generally known that the amount of stabilization chemicals is 1–200% by weight of the amount of AKD. By the use of polymers it is possible not only to improve the stability of the product but also to affect the performance of the product in paper or board. The adding of stabilizing chemicals is prior art commonly used in the formulation of AKD products.

It is generally known that rosin sizing is used specifically for affecting the peroxide resistance of board, whereas alkyl ketene dimer (AKD) primarily affects its lactic acid resistance. AKD size can be dosed to the pulp in the board machine before, after or simultaneously with resin size, depending on the manner in which the board machine is run. The dosing order does not affect the performance of the invention.

It has been observed, surprisingly, that peroxide resistance specifically derived from rosin sizing can be increased by using complexing agents which are dosed together with the rosin size or are incorporated into the product. Complexing agents suitable for this purpose include agents which react slowly with aluminum compounds and rapidly with alkaline earth metal ions.

According to the invention there is thus provided a process for the manufacture of hydrophobic paper or board by using rosin sizing, the process being characterized in that an organic complexing agent is used together with the rosin size.

The term chelating agent is also used for complexing agents.

According to the invention, the organic complexing agent can be incorporated into the rosin size or it can be dosed at the same location in the paper or board machine as the rosin size.

The process according to the invention is especially suitable for sizing together with an aluminum compound, such as aluminum sulfate, aluminum chloride, polyaluminum chloride, polyaluminum sulfate or mixtures of these.

Suitable complexing agents which can be used in accordance with the invention include a) aminopolycarboxylic acids b) N-bis- or tris-[(1,2-dicarboxylethoxy)ethyl]amines and c) phosphonic acids.

The complexing agents cited above may be in the form of an acid or a salt. Suitable salts include alkali metal salts and ammonium salt. Sodium and potassium salts are preferred salts.

Preferred complexing agents of group a) include amino polycarboxylic acids having the following general Formula I.

(I)

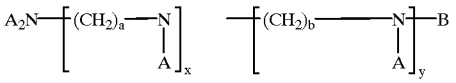

where

A is —$CH_2COOH$,

B is —$CH_2COOH$ or —$CH_2CH_2OH$, x is 0–6, preferably 0–3, y is 0–6, preferably 0–2, a is 2–10, preferably 2–4, and b is 2–10, preferably 2–6.

Especially preferable compounds according to Formula I include ethylene diamine tetra-acetic acid, i.e. EDTA (B=A, x=0, b=2 and y=1), diethylene triamine penta-acetic acid, i.e. DTPA (B=A, x=1, a=2, b=2 and y=1), and nitrilotriacetic acid, i.e. NTA (B=A, x=0 and y=0).

Preferred complexing agents of group b) include N-bis- or tris-[(1,2-dicarboxylethoxy)ethyl]amines having the general Formula II (II)

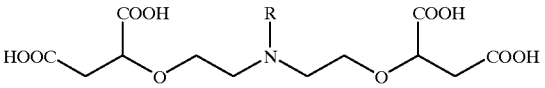

where

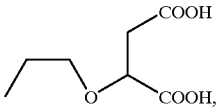

R is hydrogen, an alkyl group having 1–30 carbon atoms, an alkyl group having 1–30 carbon atoms and additionally 1–10 carboxylic acid groups, an alkyl group having 1–30 carbon atoms and additionally 1–10 carboxylic acid ester groups, a (poly)ethoxylated hydrocarbon group having 1–20 ethoxyl groups, or a carboxylic acid amide group having 1–30 carbon atoms, in which case the N—R bond is an amide bond.

Especially preferable complexing agents in Formula II include the following compounds according to Formulae A, B and C:

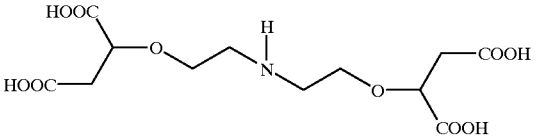

A

-continued

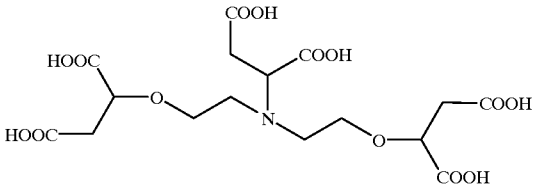

B

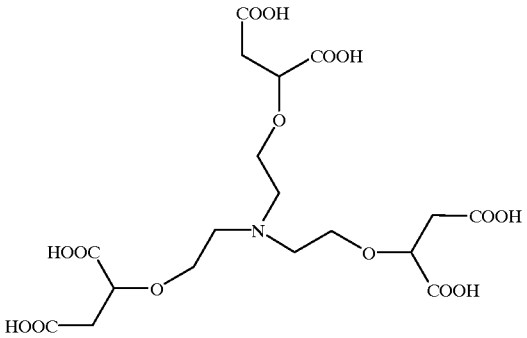

C

A = N-bis[(1,2-dicarboxylethoxy)ethyl]amine (hereinafter the acronym BCEEA will be used)

B = N-bis[(1,2-dicarboxylethoxy)ethyl]aspartic acid (hereinafter the acronym BCEEA will be used)

C = N-tris[(1,2-dicarboxylethoxy)ethyl]amine (hereinafter the acronym TCEEA will be used)

These complexing agents A, B and C and their preparation have been described in patent application FI-962261. It is also possible to use mixtures of compounds A and B.

Preferred complexing agents of group c include phosphonic acids having the general Formula III (III)

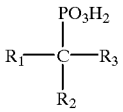

where $R_1$ is hydrogen, a lower alkyl such as —$CH_3$ or —$(CH_2)_n$—$CH_3$, an amino group —$NH_2$, hydroxy methyl —$CH_2OH$, a lower carboxylic acid group —$(CH_2)_n$—COOH, a lower alkyl phosphonic acid group —$(CH_2)_n$—$PO_3H_2$, or a group having the formula

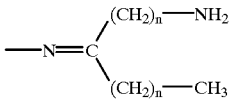

$R_2$ is hydrogen, hydroxyl —OH, a phosphonic acid group —$PO_3H_2$, a lower carboxylic acid group —$(CH_2)_n$—COOH or a group having the formula

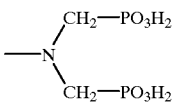

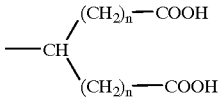

-continued

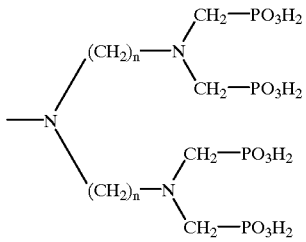

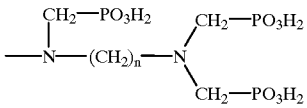

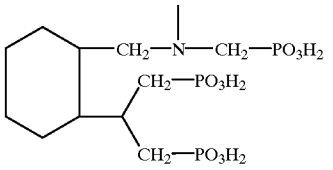

or

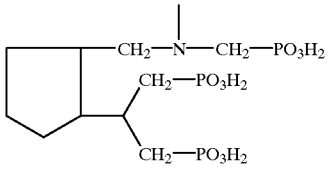

$R_3$ is hydrogen, hydroxyl —OH, an amino group —$NH_2$, a lower alkyl such as —$CH_3$ or —$(CH_2)_n$—$CH_3$, a lower carboxylic acid group —$(CH_2)_n$—COOH or a group having the formula

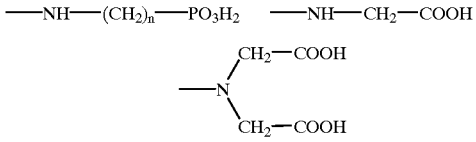

n is 0–6, preferably 0–3.

Complexing agents or their mixtures can be used in their acid forms or as their salts, as stated above. If the complexing agents are used in a salt form, the salt is not of substantial importance for the performance of the invention.

The amount of the organic complexing agent may be 0.1–20% by weight, preferably 1–10% by weight, of the amount of the active ingredient of the rosin size.

According to the invention it is possible to use, in addition to rosin size, some other agent which enhances hydrophobicity. This agent can be incorporated into the rosin size or it can be added together with the rosin size or it can be dosed in the paper or board machine at a different location than the rosin size. Such a preferable agent enhancing hydrophobicity is alkyl ketene dimer size (AKD size).

According to the invention there is also provided a sizing composition which contains resin size and a complexing agent incorporated into it. The suitable complexing agents have been defined above.

The said sizing composition is preferably in the form of a dispersion.

The invention additionally relates to the use of the organic complexing agent defined above together with a rosin size in the manufacture of hydrophobic paper or board.

The essential idea of the invention is that the organic complexing agent is used together with a rosin size, incorporated into it or dosed at the same location in the paper or board machine as the rosin size, in which case the performance of the substance is targeted close to the formation of a rosin-Al reaction product. If the said substances were dosed directly into the circulation water, their concentration should be so high that it would disturb the rest of the operation of the machine. When the complexing agent is dosed together with the rosin size, its preferred amount is 0.01–1 kg per one metric ton of board or paper. In this case the concentration of the complexing agent in the product may be 0.1–20% by weight of the active ingredient of the rosin size.

The process according to the invention is suited for use for chemical pulps, mechanical pulps and chemimechanical pulps, and mixtures of these.

The invention is described below with the help of an example. The percentages are percentages by weight, unless otherwise indicated.

EXAMPLE

For a sheet test, which was performed according to the instructions by Scan-C 26:76, there were used a chemithermomechanical pulp (CTMP) 50% and a chemical softwood pulp 50%. The mixture was ground to a Schopper number of 38°. Cooked starch was added to the mixture in an amount of 1 kg/t.

The dry matter content of the stock was set at 0.3%. The chemicals were dosed in the following order: calcium chloride, alum 1 kg/t, AKD size 2 kg/t, rosin size 3.5 kg/t, complexing agent, sodium sulfate, alum 2 kg/t, cationic starch 5 kg/t. The complexing agent was contained in the rosin size dispersion. In the final product the pH was approx. 6.

Complexing Agent 1, which contains BCEEA and BCEEAA at a molar ratio of 2:3, was used in the tests.

The grammage of the sheets was 138 g/$m^2$. Calcium chloride was added to the stock before the adding of the first alum batch and sodium sulfate was added after the adding of the rosin size, in accordance with Table 1.

Determination of peroxide REP: Tape-coated paper strips (2.5 cm×7.5 cm), the edges of which-were left free, were immersed for the duration of 10 min in a 70° C. hydrogen peroxide solution having a concentration of 30%. The strips were weighed and the amount of penetrated liquid per cross-sectional area of the strip was measured.

Determination of lactic acid REP: Tape-coated paper strips (4.5 cm×12 cm), the edges of which were left free, were immersed for the duration of 1 hours in a 25° C. lactic acid solution having a concentration of 1%. The strips were weighed and the amount of penetrated liquid per cross-sectional surface of the strip was measured.

TABLE 1

| Test | Compl. agent 1 kg/t | $Na_2SO_4$ kg/t | $CaCl_2$ kg/t | $H_2O_2$ REP 10 min kg/$m^2$ | Lactic acid REP 1 h kg/$m^2$ |
|---|---|---|---|---|---|
| 1 | 0 | 0 | 0 | 2.52 | 0.50 |
| 2 | 0.2 | 0 | 0 | 1.03 | 0.42 |
| 3 | 0 | 3 | 0 | 2.24 | 0.48 |
| 4 | 0.2 | 3 | 0 | 1.06 | 0.46 |
| 5 | 0 | 3 | 3 | 2.33 | 0.55 |
| 6 | 0.2 | 3 | 3 | 1.09 | 0.55 |

The test results show that Complexing Agent 1 (tests 2, 4 and 6) considerably improves specifically the peroxide solution penetration, dependent on rosin sizing, inwards from the edge of board. The adding of sulfate improves the result without a complexing agent but disturbs somewhat the action of the complexing agent. The adding of calcium degrades the result.

What is claimed is:

1. A process for the manufacture of hydrophobic paper or board by using rosin sizing, which comprises combining an organic complexing agent together with a rosin size, wherein the organic complexing agent is selected from the group consisting of aminopolycarboxylic acids of formula I:

(I)

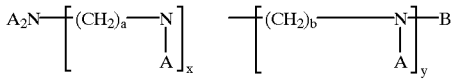

wherein A is —$CH_2COOH$, B is —$CH_2COOH$ or —$CH_2CH_2COOH$, X is 0 to about 6, Y is 0 to about 6, wherein at least one of X and Y is at least 1, a is 2 to about 10, and b is 2 to about 10;

n-bis or tris[1,2-dicarboxylethoxy)ethyl]amines of formula II:

(II)

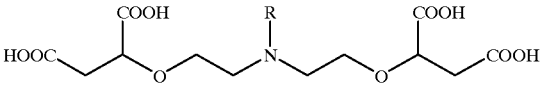

wherein R is hydrogen, an alkyl group having from 1 to about 30 carbon atoms, an alkyl group having from 1 to about 30 carbon atoms and 1 to about 10 carboxylic acid groups, an alkyl group having from 1 to about 30 carbon atoms and 1 to about 10 carboxylic acid ether groups, a (poly)ethoxylated hydrocarbon group having from 1 to about 20 ethoxyl groups, a carboxylic acid amide group having from 1 to about 30 carbon atoms and an NR bond that is an amide bond, or a group having the formula:

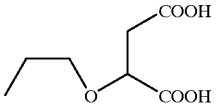

and phosphonic acids of formula III (III)

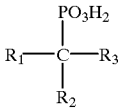

wherein $R_1$ is hydrogen, —$(CH_2)_n$—$CH_3$, —$NH_2$, —$CH_2OH$, —$(CH_2)_n$—COOH, —$(CH_2)_n$—$PO_3H_2$, or a group of formula

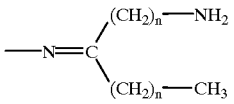

wherein n is 0 to about 6.

$R_2$ is hydrogen, —OH, —$PO_3H_2$, —$(CH_2)_m$—COOH, or a group of formula

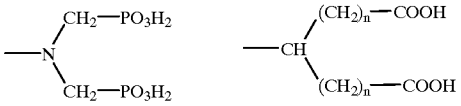

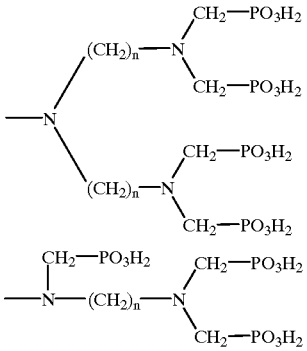

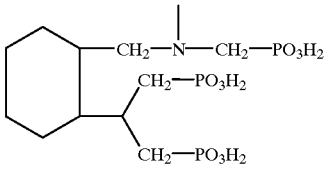

or

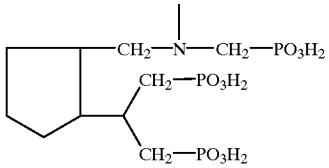

wherein m is 0 to about 6; and $R_3$ is hydrogen, —OH, —$NH_2$, —$(CH_2)_o$—$CH_3$, —$(CH_2)_o$—COOH, —NH—$(CH_2)_o$—$PO_3H_2$, —NH—$CH_2$—COOH, or —$N(CH_2COOH)_2$, wherein o is 0 to about 6.

2. The process of claim 1, wherein the organic complexing agent is incorporated into the rosin size or is dosed at the same location in a paper or board machine as the rosin size.

3. The process of claim 1 wherein an aluminum compound is used for sizing.

4. The process of claim 1, wherein the organic complexing agent is diethylene triamine penta-acetic acid (DTPA), ethylene diamine tetra-acetic acid (EDTA) or nitrilotriacetic acid (NTA), or a salt thereof or a mixture thereof, or is N-bis[(1,2-dicarboxylethoxy)ethyl]amine (BCEEA), N-bis[(1,2-dicarboxylethoxy)ethyl]-aspartic acid (BCEEEAA) or N-tris[(1,2-dicarboxylethoxy)ethyl]amine (TCEEA), or a salt thereof or a mixture thereof.

5. The process of claim 1, wherein the amount of the organic complexing agent is 0.1–20% by weight, of the active ingredient of the rosin size.

6. The process of claim 1, wherein the rosin size and organic complexing agent are further combined together with a hydrophobicity-enhancing agent.

7. The process of claim 6, wherein the agent enhancing hydrophobicity is an alkyl ketene dimer size.

8. A sizing composition, which comprises a rosin size and an organic complexing agent incorporated therein, wherein the organic complexing agent is selected from the group consisting of aminopolycarboxylic acids of formula I:

(I)

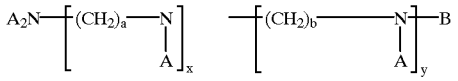

wherein A is —$CH_2COOH$, B is —$CH_2COOH$ or —$CH_2CH_2COOH$, X is 0 to about 6, Y is 0 to about 6, wherein at least one of X any Y is at least 1, a is Z to about 10, and b is 2 to about 10; n-bis or tris[1,2-dicarboxylethoxy)ethyl]amines of formula II:

(II)

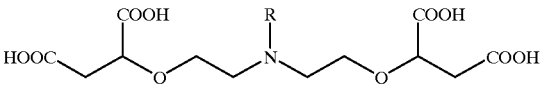

wherein R is hydrogen, an alkyl group having from 1 to about 30 carbon atoms, an alkyl group having from 1 to about 30 carbon atoms and 1 to about 10 carboxylic acid groups, an alkyl group having from 1 to about 30 carbon atoms and 1 to about 10 carboxylic acid ether groups, a (poly)ethoxylated hydrocarbon group having from 1 to about 20 ethoxyl groups, a carboxylic acid amide group having from 1 to about 30 carbon atoms and an NR bond that is an amide bond, or a group having the formula

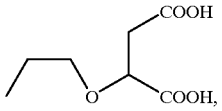

and phosphonic acids of formula III (III)

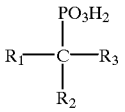

wherein $R_1$ is hydrogen, —$(CH_2)_n$—$CH_3$, —$NH_2$, —$CH_2OH$, —$(CH_2)_n$—COOH, —$(CH_2)_nPO_3H_2$, or a group of formula

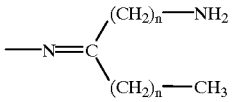

wherein n is 0 to about 6, $R_2$ is hydrogen, —OH, —$PO_3H_2$, —$(CH_2)_m$—COOH, or a group of formula

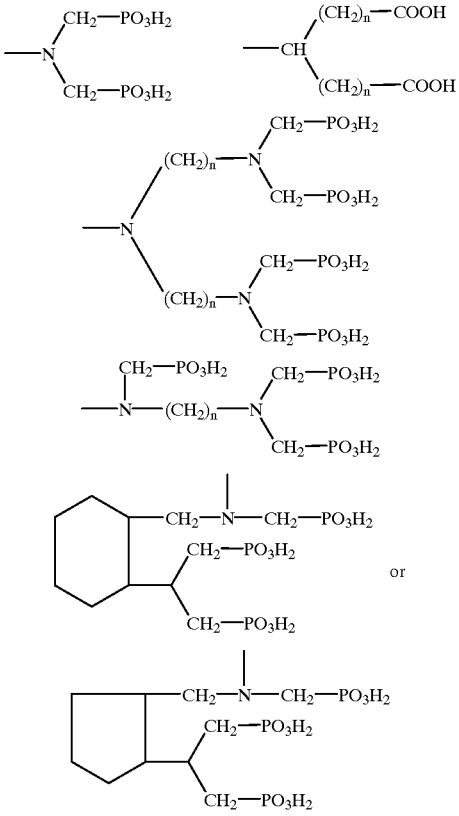

wherein m is 0 to about 6; and $R_3$ is hydrogen, —OH, —$NH_2$, —$(CH_2)_o$—$CH_3$, —$(CH_2)_o$—COOH, —NH—$(CH_2)_o$—$PO_3H_2$, —NH—$CH_2$—COOH, or —$N(CH_2COOH)_2$, wherein o is 0 to about 6.

9. The composition of claim 8, wherein said composition is a dispersion.

10. The process of claim 1, wherein the amount of the organic complexing agent is 1–10% by weight of the active ingredient of the rosin size.

11. A hydrophobic paper or board produced by the process of claim 1.

12. A hydrophobic paper or board produced by the process of claim 1.

13. A hydrophobic paper or board produced by the process of claim 4.

14. A hydrophobic paper or board which comprises the sizing composition of claim 8.

15. The composition of claim 8 wherein the organic complexing agent is diethylene triamine penta-acetic acid (DTPA), ethylene diamine tetra-acetic acid (EDTA) or nitrilotriacetic acid (NTA), or a salt thereof or a mixture thereof, or is N-bis[(1,2-dicarboxylethoxy)ethyl]amine (BCEEA), N-bis[(1,2-dicarboxylethoxy)ethyl]-aspartic acid (BCEEAA) or N-tris[(1,2-dicarboxylethoxy)ethyl]amine (TCEEA), or a salt thereof or a mixture thereof.

* * * * *